United States Patent [19]

Röck et al.

[11] Patent Number: 4,680,830

[45] Date of Patent: Jul. 21, 1987

[54] FURNITURE HINGE HAVING AN INTERMEDIATE MOUNTING MEMBER AND A SEPARATE DISENGAGING MECHANISM

[75] Inventors: Erich Röck, Höchst; Helmut Rupprechter; Klaus Brüstle, both of Lauterach, all of Austria

[73] Assignee: Julius Blum Gesellschaft m.b.H., Höchst, Austria

[21] Appl. No.: 783,638

[22] Filed: Oct. 3, 1985

[30] Foreign Application Priority Data

Oct. 19, 1984 [AT] Austria ..... 3340/84

[51] Int. Cl.[4] ..... E05D 7/06

[52] U.S. Cl. ..... 16/241; 16/246; 16/382

[58] Field of Search ..... 16/241, 245, 246, 382, 16/DIG. 39

[56] References Cited

FOREIGN PATENT DOCUMENTS

| | | | |
|---|---|---|---|
| 43903 | 1/1982 | European Pat. Off. | 16/382 |
| 2458566 | 7/1975 | Fed. Rep. of Germany | 16/245 |
| 2460127 | 6/1976 | Fed. Rep. of Germany . | |
| 2733831 | 7/1977 | Fed. Rep. of Germany | 16/382 |
| 3026796 | 1/1982 | Fed. Rep. of Germany . | |
| 3039328 | 5/1982 | Fed. Rep. of Germany . | |
| 3235402 | 3/1984 | Fed. Rep. of Germany | 16/245 |
| 3241284 | 5/1984 | Fed. Rep. of Germany . | |

*Primary Examiner*—Fred Silverberg

*Attorney, Agent, or Firm*—Wenderoth, Lind & Ponack

[57] ABSTRACT

A hinge includes a hinge arm having a U-shaped profile. The hinge arm is adjustably held on a mounting plate by a self-resilient member formed, of sheet steel. The member is also adjustably held on the hinge arm and embraces the mounting plate at both sides from above. Clamp portions of the sheet steel member engage in lateral grooves of the mounting plate.

7 Claims, 4 Drawing Figures

FURNITURE HINGE HAVING AN INTERMEDIATE MOUNTING MEMBER AND A SEPARATE DISENGAGING MECHANISM

FIELD AND BACKGROUND OF THE INVENTION

The invention relates to a hinge comprising a hinge arm having a U-shaped profile and being adjustably held on a mounting plate by means of a self-resilient member formed of sheet steel.

DESCRIPTION OF THE PRIOR ART

In conventional furniture hinges, the hinge arm is fastened to the mounting plate by means of a clamping screw that generally projects through an oblong hole to permit an adjustment of the hinge arm in the direction of the depth of the particular article of furniture.

Recently, snap connections for fastening the hinge arm to the mounting plate have become known. DE-A-30 26 796 and DE-A-30 39 328, for example, show hinges each comprising a hinge arm and a fastening plate in which the hinge arm is inserted into a guide of the fastening plate and displaced in a longitudinal direction. Thus, the two parts to be locked to each other snap into each other. A similar manner of anchoring a hinge arm to a mounting plate is shown in DE-A-24 60 127. DE-A-32 41 284 shows a hinge in which the hinge arm is insertable into lateral guides of a mounting plate and clampable to the mounting plate by means of an eccentric.

The above-described manner of anchoring of the hinge arm to the mounting plate has the advantages that the hinge arm can be fixed to the mounting plate very quickly when the piece of furniture is assembled, and that no tools are required for the mounting operation. Such advantages are not unimportant because the furniture door must be held when the hinge arms are mounted. When, for example, the door is held with one hand and the hinge arm is mounted with the other hand, a second person is often needed to fasten the clamping screw by means of a screw driver, if the hinge arm is locked by means of a clamping screw.

SUMMARY OF THE INVENTION

It is the object of the invention to provide a hinge with resilient snap-in locking that is of simple construction and whereby a depth adjustment of the hinge arm is possible when the hinge arm has been mounted onto the mounting plate.

According to the invention, this is achieved in that a resilient member formed of sheet steel is adjustably mounted on the hinge arm, is pushable onto the mounting plate vertically to the mounting plane, embraces the mounting plate at both sides from above and engages into lateral grooves of the mounting plate by means of clamp portions.

It is preferably provided that the steel sheet member has an angular stop flap which abuts on an end face of the mounting plate which is directed to the door of the article of furniture.

An embodiment of the invention provides that the sheet steel member has preferably centrally arranged spreading members pressing on the mounting plate from above.

Four clamp portions are advantageously provided.

A further embodiment of the invention provides a spreading part by means of which the clamp portions can be spread apart. Advantageously, such spreading part is a slide member guided in lateral slots of the steel sheet member.

One embodiment of the invention provides that, above the grooves, the mounting plate has oblique side faces diverging towards the mounting plate.

Thus, the sheet steel member can be pressed onto the mounting plate more easily.

It is further advantageously provided that the slide has legs which project beside the clamp portions of the steel sheet member towards the mounting plate, each leg including a portion parallel to the clamp portions and a portion which is bent outwardly.

BRIEF DESCRIPTION OF THE DRAWINGS

In the following an embodiment of the invention will be described in more detail with reference to the accompanying drawings, in which.

Figure 1:
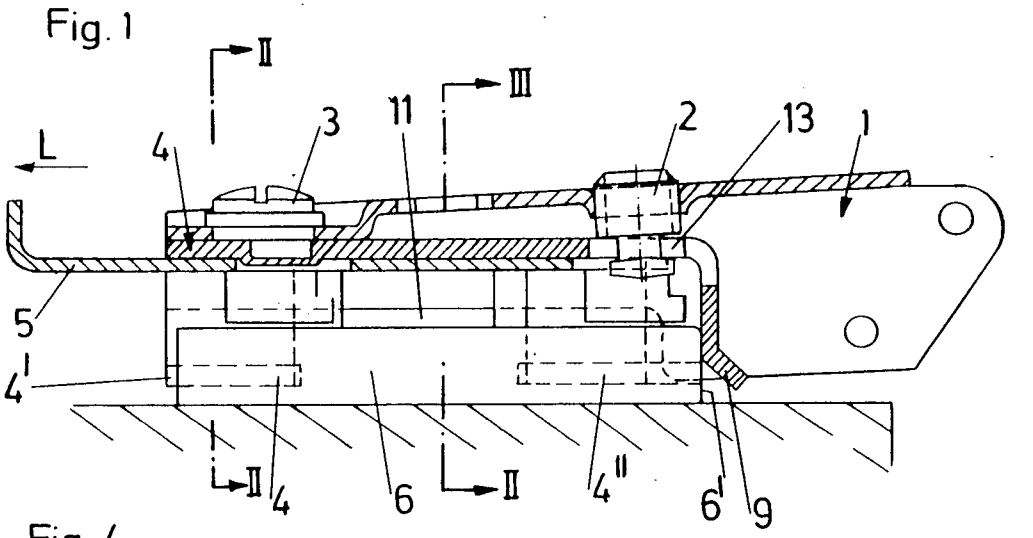
FIG. 1 is a longitudinal sectional view of a hinge arm and a mounting plate in a mounted position.
Figure 4:
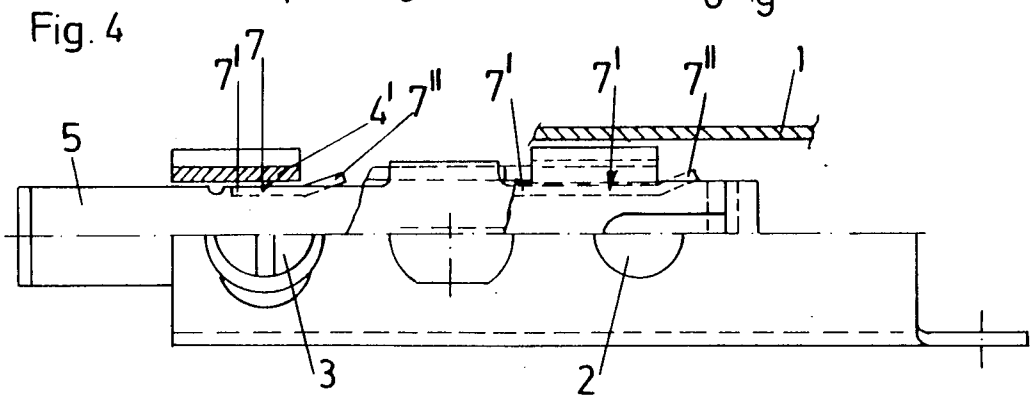
FIG. 4 is a top view, parts thereof in section, of the hinge arm mounted on the mounting plate.
Figure 2:
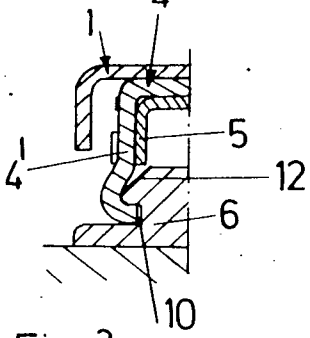
FIGS. 2 and 3 are partial sectional views taken along lines II—II and III—III, respectively, of FIG. 1.

In the drawings, those hinge parts which are not directly related to the invention, such as the hinge casing and the hinge links, have not been illustrated.

DESCRIPTION OF THE PREFERRED EMBODIMENT

As can be seen from FIGS. 1 to 4, the hinge in accordance with the invention substantially comprises, a mounting plate to be mounted on a wall of an article of furniture 6, a hinge arm 1 to be connected to a door of the article of furniture, a holding element or intermediate member in the form of sheet steel member 4, and a slide 5.

The sheet steel member 4 is riveted to an eccentric 3 mounted in the hinge arm 1 and thus is connected with the hinge arm 1.

At the front, i.e. near its end at the side of the hinge link, the hinge arm 1 has a joint adjustment screw 2 which is mounted in a female thread of the hinge arm 1 and in a slot 13 of the sheet steel member 4. The slot 13 is T-shaped, when viewed from the top.

At the front and at the rear, the steel sheet member 4 has a substantially U-shaped cross-section and comprises clamp portions 4' and 4''. The steel sheet member 4 further comprises an angular stop flap 9 which abuts on the end face 6' of mounting plate 6 when the hinge arm 1 has been pushed onto the mounting plate.

The steel member 4 further has two spreading members 11 which are bent out of the material of the steel member 4. When the hinge arm 1 has been pushed onto the mounting plate, the spreading members 11 press onto the mounting plate 6 such that the hinge parts are held together without clearance.

For mounting, the hinge arm 1 need only be pushed onto the mounting plate 6 from above. The term "from above" is employed herein with reference to the drawings. The clamp portions 4',4'' of the steel member 4 snap automatically into grooves 10 formed in the sides of mounting plate 6.

To facilitate the mounting of the hinge arm 1, the mounting plate 6 is provided with oblique faces 12.

When the hinge arm 1 has been mounted on the mounting plate 6, an adjustment of the hinge in the direction of the joint of the furniture door and in the direction of the depth of the piece of furniture can be effected in a conventional manner by turning the joint adjustment screw 2 and the eccentric 3, respectively.

The slide 5 is provided for releasing the steel member 4. As can be seen from FIGS. 2 and 4, portions of the slide 5 have U-shaped profiles.

Legs 7 of the slide 5 are disposed adjacent the clamp portions 4',4'' of the sheet steel member 4. Each leg 7 has a portion 7' parallel to the adjoining clamp portions 4' or 41'' and a portion 7'' which is outwardly bent.

Figure 3:
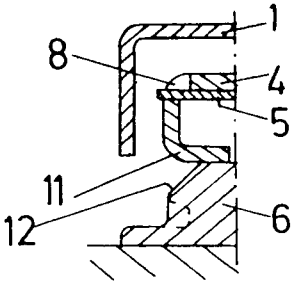

The slide 5 is, as can be seen from FIG. 3, held in lateral slots 8 of the sheet steel member 4.

When the hinge arm 1 is to be released from the mounting plate 6, the slide 5 is displaced to the left, i.e. in the direction of arrow L of FIG. 1. The portions 7'' of the legs 7 then spread the clamp portions 4',4'' apart, and the hinge arm 1 can be lifted from the mounting plate 6 by means of the steel sheet member 4.

What is claimed is:

1. A furniture hinge comprising:

a mounting plate to be mounted on a wall of an article of furniture, said mounting plate having an inner side to face the furniture wall, an outer side to be directed away from the furniture wall, and opposite lateral sides having outwardly facing grooves therein;

a hinge arm having a U-shaped profile and to be connected to a door of the article of furniture;

an intermediate member for mounting said hinge arm on said mounting plate, said intermediate member being connected to said hinge arm by means of an adjustment element for adjusting the spacing between said hinge arm and said mounting plate and by means of an adjustment member for adjusting the position of said hinge arm relative to said mounting plate in a longitudinal direction parallel to said lateral sides;

said intermediate member being formed of sheet steel and having integral resilient side clamp portions, such that said hinge arm and said intermediate member may be manually pushed in a direction toward said outer side of said mounting plate and said clamp portions resiliently snap into and engage in said grooves with said intermediate member including said clamp portions embracing said mounting plate; and separate spreading means mounted on said intermediate member for relative movement therebetween for spreading said clamp portions apart and disengaging said clamp portions from said grooves such that said intermediate member and said hinge arm may be released from said mounting plate.

2. A hinge as claimed in claim 1, wherein said intermediate member includes four said integral clamp portions.

3. A hinge as claimed in claim 1, wherein said spreading means comprises a slide member guided in lateral slots in said intermediate member for movement relative thereto in a longitudinal direction transverse to said direction of manual pushing.

4. A hinge as claimed in claim 3, wherein said slide member has legs extending adjacent respective said clamp portions, each said leg including a first portion extending parallel to the respective said clamp portion and a second portion extending obliquely outwardly to contact and spread outwardly said respective clamp portion upon movement of said slide member in said longitudinal direction relative to said intermediate member.

5. A hinge as claimed in claim 1, wherein said intermediate member further includes centrally positioned members pressed against said outer side of said mounting plate when said clamp portions are engaged in said grooves.

6. A hinge as claimed in claim 1, wherein said lateral sides of said mounting plate have oblique surfaces diverging from said outer side to said inner side at positions between said outer side and said grooves.

7. A hinge as claimed in claim 1, wherein said intermediate member further includes a projecting stop to abut an end face of said mounting plate that is to be directed toward the furniture door.

* * * * *